US007097327B1

(12) United States Patent
Barton

(10) Patent No.: US 7,097,327 B1
(45) Date of Patent: Aug. 29, 2006

(54) LEVER PIVOT SAFETY STOP SOCKET FOR FLUORESCENT LAMPS

(76) Inventor: Daniel W Barton, P.O. Box 131, Sunset Beach, CA (US) 90742

( * ) Notice: Subject to any disclaimer, the term of this patent is extended or adjusted under 35 U.S.C. 154(b) by 50 days.

(21) Appl. No.: 11/085,318

(22) Filed: Mar. 21, 2005

(51) Int. Cl.
*F21Y 103/00* (2006.01)

(52) U.S. Cl. ..... 362/260; 362/649; 439/232; 439/356; 439/372

(58) Field of Classification Search ..... 362/260, 362/649, 651; 439/226, 232, 356, 372
See application file for complete search history.

(56) References Cited

U.S. PATENT DOCUMENTS 5,371,661 A * 12/1994 Simpson ..... 362/220

6,890,199 B1 * 5/2005 Vogt et al. ..... 439/238

* cited by examiner

*Primary Examiner*—Laura K. Tso
(74) *Attorney, Agent, or Firm*—Monty Koslover

(57) ABSTRACT

A lever pivot safety stop socket for fluorescent lamps. The device consists of a molded plastic housing which includes electrical contact strips, attached to power leads; and a plastic, levered and slotted rotor. The rotor fits into an opening in the housing face, leaving its lever portion outside, and able to turn the rotor. Both housing top and lever portion include a wide slot, and when the lever is pointing towards the housing top, the slots line up. This is the lamp installation position, allowing lamp terminal end pins to be easily dropped into the housing slot and into the rotor slots. The lamp can then be rotated a quarter turn in either direction by the lever, to make a full connection with the power contacts in the housing. Provision is made so that no more than a quarter turn can be made from the installation position in either direction, avoiding "opens", arcing and possible damage. A mounting bracket is attached to the housing for mounting the socket.

3 Claims, 5 Drawing Sheets

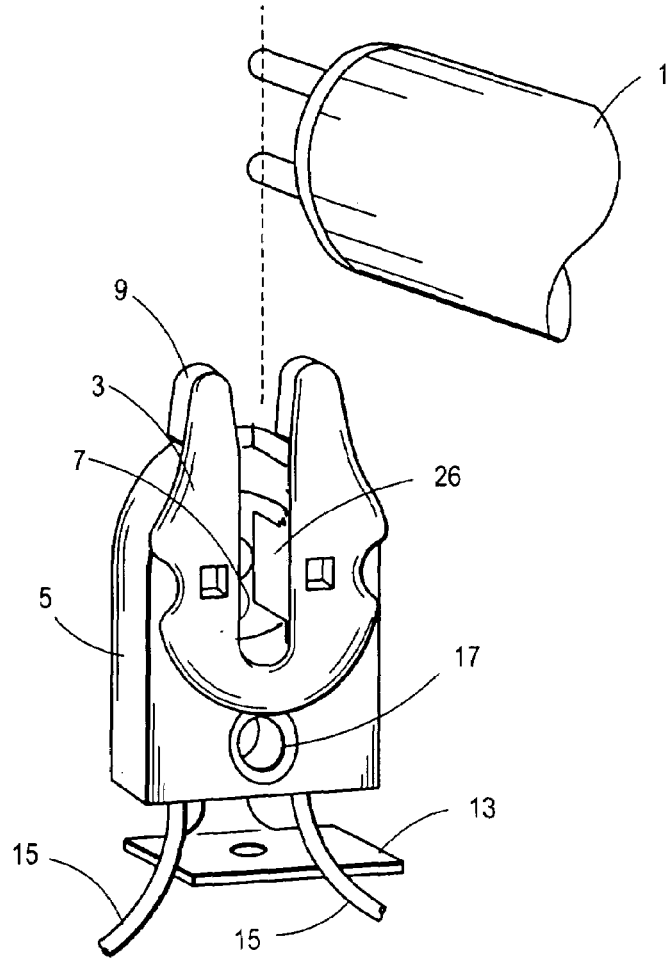
FIG. 1
FIG. 2
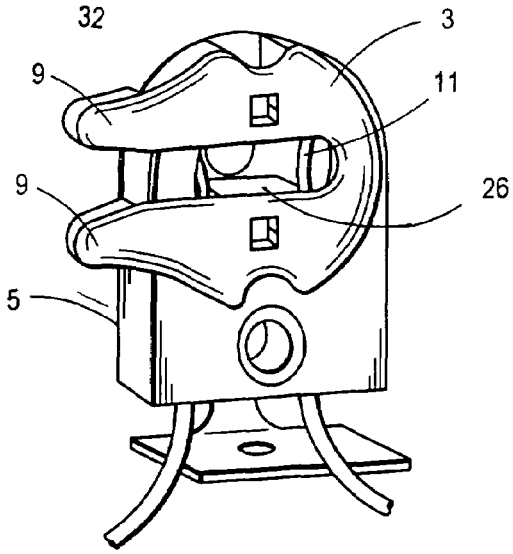
FIG. 3
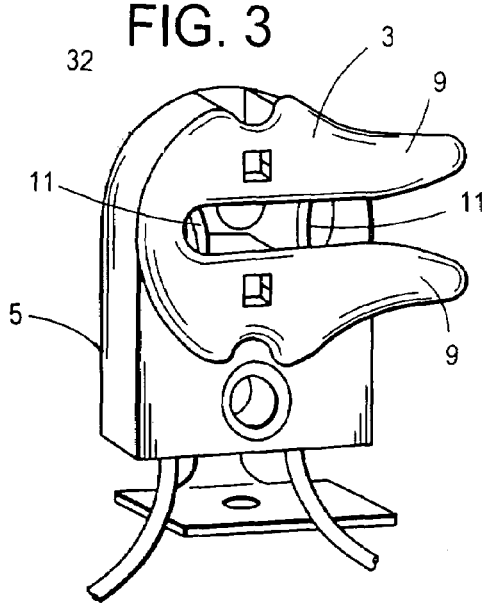

FIG. 9
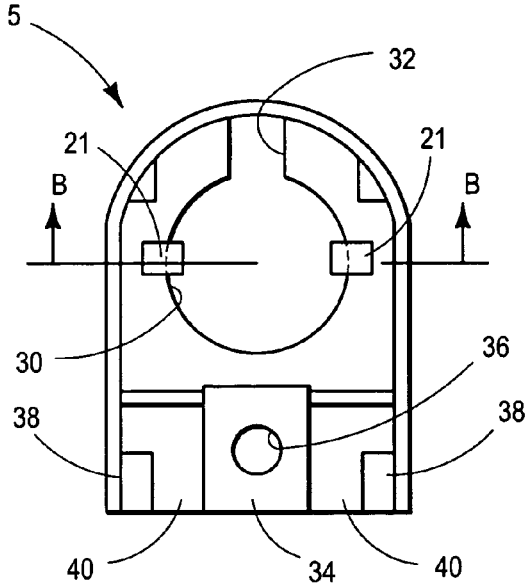
FIG. 10
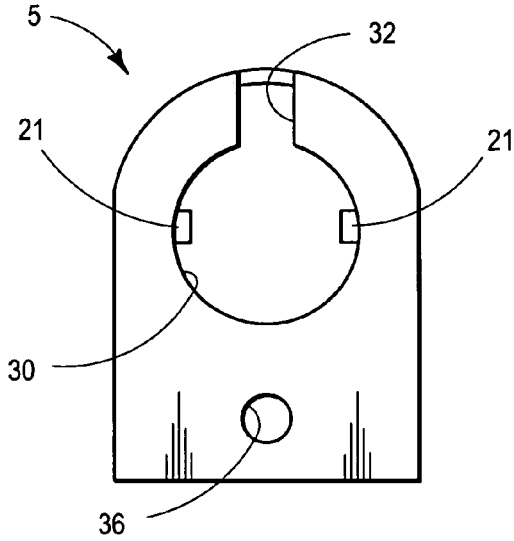
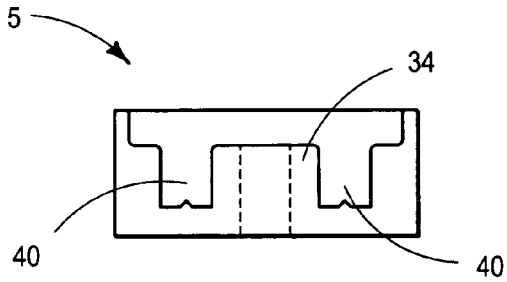
FIG. 11
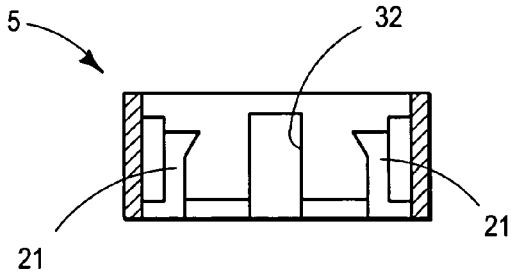
FIG. 12

LEVER PIVOT SAFETY STOP SOCKET FOR FLUORESCENT LAMPS

1. FIELD OF THE INVENTION

This invention relates to light fixtures for fluorescent lamps, and more particularly to the fixture lamp sockets.

2. BACKGROUND

At present, conventional fluorescent lamp sockets are designed so that for a lamp installation, it is necessary to first line up the lamp parallel end pins with a central slit in the socket face, push both ends of the lamp all the way into the socket slit and then, holding the lamp, manually rotate the lamp about a quarter turn. The lamp should then be installed. The reverse steps are performed to remove a lamp from the fixture.

Problems may arise because a lamp may be rotated more than a quarter turn in a socket during installation. Due to built in tolerances separating the thin insulating components from the curved socket contacts, any over rotation or under rotation can result in only one of the two lamp end pins making electrical contact. Such contact may also be intermittent, particularly if the sockets are old and the contacts have deformed or pitted surfaces. The result is arcing which can damage a lamp as well as a socket, leading to a required removal and replacement of a lamp.

This situation is a common problem particularly for small, tubular fluorescent lamps that are installed in closed areas such as display cases. Because of their size and location it is difficult for even a skilled person to see and correctly install or remove a lamp for replacement. The problem is made worse by the fact that a failed lamp in a showcase is likely to be very hot, and so more difficult to grip, rotate and remove.

There is therefore, a need for a fluorescent lamp socket that makes installation or removal of a small size lamp easy, and the lamp can not be over or under rotated in a socket.

SUMMARY OF THE INVENTION

The invention is a lever pivot safety stop socket for fluorescent lamps. The socket consists primarily of a molded rigid plastic housing, that has a wide insertion slot in a the housing top surface, and contains two metal, permanently bent contact strips that are each attached to power leads, and a molded plastic levered rotor. The rotor includes a vertical, wide slot in its front lever portion and a matching axial slot in its perpendicular rotor body that is attached to the lever portion. The rotor body is inserted in a hole in the housing face and retained in the housing with the lever portion positioned with its slot lined up with the insertion slot in the housing top. In this lever position, the end pins of a fluorescent lamps can easily be dropped and inserted in the housing top and into the rotor body, and guided by the lever slot. The lamp can the be rotated, using the socket lever members, a quarter turn in either direction to make a connection with the power contacts in the housing. Provision is made so that no more than a quarter turn can be made from the installation position in either direction. A mounting bracket is attached to the housing for mounting the socket.

Accordingly, it is an object of the present invention to improve the ability of removing and replacing lamps.

Another object is to ensure that no arcing can take place with an installed lamp and possibly cause damage.

Yet another object is to provide a safety stop so that a lamp can not be rotated more than a quarter turn.

Further objects and advantages of the present invention will become apparent from a study of the following specification portion, the claims and the attached drawings.

BRIEF DESCRIPTION OF THE DRAWINGS

FIG. 1 is a perspective view of a lever pivot safety stop socket according to the present invention, particularly showing the socket ready for insertion of a fluorescent lamp end pins in a slot through the top of the socket;

FIG. 2 is a perspective view of the invention socket, showing the front levered rotor rotated −90 deg. and particularly showing an electrical contact on either side of a center opening in the socket;

FIG. 3 is a perspective view of the invention socket, showing the socket, with its front levered rotor rotated +90 deg., and also showing an electrical contact on either side of a center opening;

FIG. 9 is a back elevation view of the socket housing;

FIG. 10 is a front elevation view of the socket housing;

FIG. 11 is a bottom end view of the socket housing, particularly showing two openings for insertion of the electrical leads with attached contacts;

FIG. 12 is a cutaway view of the socket housing taken along line B—B of FIG. 9, and particularly showing means for retaining the levered rotor in the housing;

DESCRIPTION OF THE PREFERRED EMBODIMENT

Figure 4:
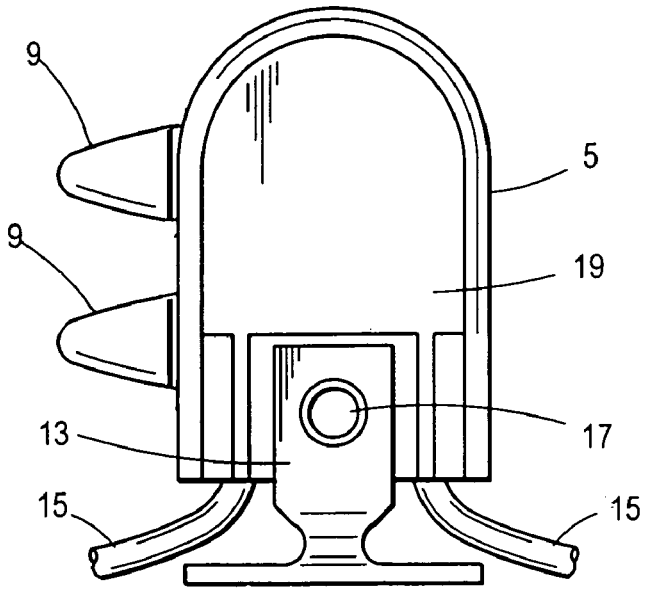
FIG. 4 is a back elevation view of the invention socket, particularly showing a metal mounting bracket riveted to the socket cover.

The invention is a lever pivot, safety-stop socket for use with tubular fluorescent lamps, particularly for small size, low wattage lamps.

Referring to FIG. 1, there is shown a front perspective view of the invention socket and an end part of a fluorescent lamp 1, with the lamp terminal pins lined up for insertion in an opening that is presented by the socket top end.

A slot 7 that is formed in the lever member portion of a rotor 3, acts as a guide for lamp terminal pins that are inserted in the top opening in the socket housing 5. The lamp terminal pins are passed through the housing until one pin rests on the lower end of the lever member slot 7 and the lamp end is firmly seated, abutting the rotor 3 on the socket face.

As depicted in FIG. 1, the position of the rotor 3 is set at zero deg., which is an installation setting that is intended for insertion of a lamp terminal pins. The rotor 3 may be rotated using the lever member, to a −90 deg. position as shown in FIG. 2, or rotated to a +90 deg. position as shown in FIG. 3. In either the −90 deg. or +90 deg. position, the socket is "locked" or fully closed. The rotor 3 can not be turned more than +/−90 deg. because of straight-edged pads on the lever arm ends 9, that closely abut the side of the housing 5 when at a +90 deg. or −90 deg. lever rotation angle; blocking further rotation.

User operation of the invention socket is simple. The end pins of a tubular fluorescent lamp 1 are first dropped in a top opening in the sockets, and guided by the rotor lever slot 7, which is initially vertical, into a rotor body slot.

Secondly, the fluorescent lamp 1 is manually rotated, using a rotor lever member, in either rotational direction until it stops. A stop will occur at about 90 degrees or a quarter turn. At this point, the lamp is firmly connected to the electric power lines. The user will see that the rotor lever members on both sockets are now pointing horizontally, instead of vertically as at the start. Removal of a lamp is done by reversing the above steps.

Electrical power connection is made by having the lamp pins initially wipe spring loaded contact strips over a short distance of the turning arc, before stopping. Thus there is no arcing at connection or disconnection, and electrical connection is always firm and complete.

Means described herein, are provided to prevent a socket rotor 3 from being rotated more than a quarter turn and possibly damaging a lamp or socket.

Refer now again to FIG. 1. Inside the housing 5 are a pair of long, permanently bent, springy brass electrical contact strips 11 that are disposed vertically, one on each side of the rotor 3 body, with a surface bearing against the rotor 3. The contact strips 11 are each attached to electrical power leads 15 which are brought out a bottom end of the housing 5.

A mounting bracket 13 is provided and is joined to the back cover of the housing 5 by a rivet 17. The rivet 17 passes through the housing, and holds the cover tightly to the housing walls.

It can be seen in FIG. 1 that no contact strips 11 are visible through the lever slot 7 when the rotor 3 and slot 7 openings are at 0 deg. or vertical. This is because, in this socket "open" position, the contact strips 11 both bear against an outer surface of two parallel walls 27 that define a rotor body opening 26, inside the housing. Since the rotor slot 7 is fixed to line up with the rotor body opening 26, the contact strips 11 are kept outside the rotor body walls, and prevented from touching the pins of any inserted fluorescent lamp.

Refer now to FIGS. 2 and 3. When the rotor 3 is turned either −90 deg. or +90 deg., the contact strips 11 become positioned across the open sides of the rotor body opening 26 and are now exposed. They are then available to wipe and impinge on both lamp pins that may have been inserted earlier and seated in the socket rotor; connecting the electric power leads to the lamp.

Figure 5:
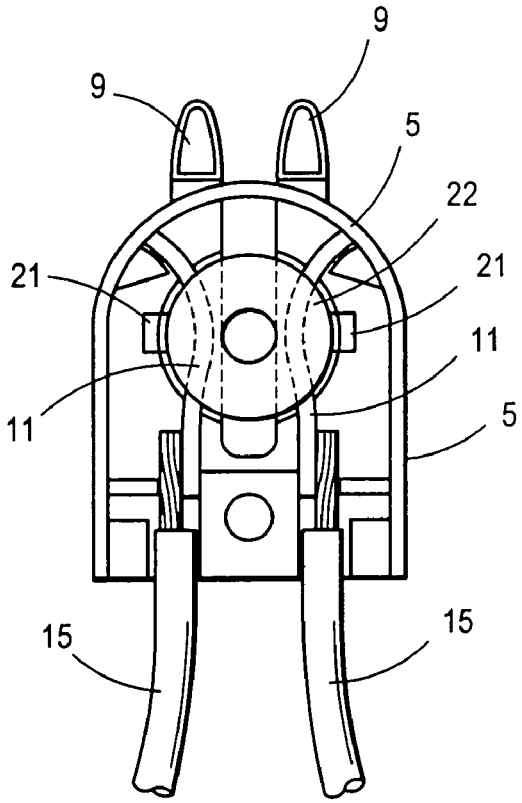
FIG. 5 is a back elevation view of the socket with the cover lid removed, particularly showing electrical leads, with attached contact strips in place.
Figure 6:
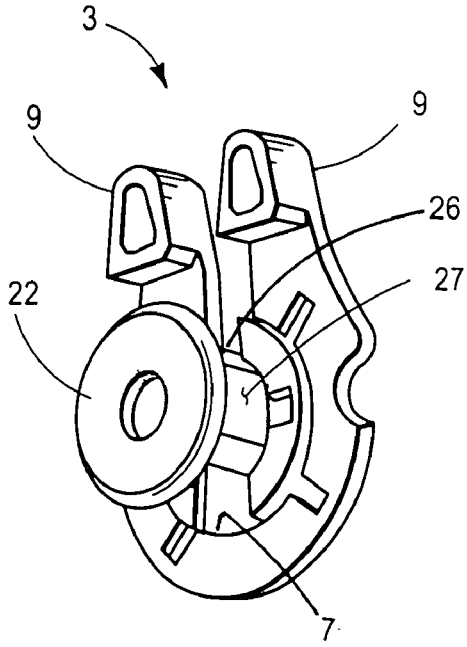
FIG. 6 is a back perspective view of the levered rotor.

Please refer to FIGS. 4, 5 and 6.

FIGS. 4 and 5 are respectively a back elevation view and an open back elevation view of the invention socket. FIG. 6 is a back perspective view of the molded plastic rotor 3 and will help in understanding the following discussion.

In the FIG. 4 view, the rotor 3 lever has been turned a quarter turn, so the lever arm end pads 9 are shown to be abutting a side of the housing 5. A cover lid 19 fits into the molded housing 5, and a mounting bracket 13 tang, which fits into a cover recess, is riveted 17 together with the cover lid 19 to the housing 5.

In the open back view of FIG. 5, The rotor 3 is in the zero deg. installation position described earlier in FIG. 1. For the sake of clarity of understanding, several parts have been exaggerated in size and proportion. The ends of the power leads 15 lie in parallel grooves that are created by surface projections in the housing 5. Attached to the bare wire end of each power lead 15, is a spring-flexed contact strip 11 which is inserted under the end disk 22 of the rotor body. The strips are placed between a clamp post 21 and the rotor body, and oriented so that the contact strip surface bears directly on the surface of a rotor body side wall 27.

As shown in FIG. 5, when the rotor 3 is in a zero deg. position, the contact strips 11 are essentially paralleled with the rotor lever slot 7 and rotor body opening 26, and do not face into the body opening 26. When the rotor 3 is turned a quarter turn, a center portion of each contact strip 11 looks directly into the rotor body opening and is available to contact inserted lamp end pins.

The clamp posts 21 are flexible plastic projections that retain a rotor 3 body that is inserted in the housing 5, by clamping the axial rotor body immediately underneath a body end disk 22.

The rotor 3, as shown in FIG. 6, is an assembly of two molded plastic parts; a lever member and a rotor body which are riveted together. The lever member has a generally flat surface on its inward and face sides, except at the parallel lever arm ends, where the inward side has a sharply stepped block or pad 9. The pads 9 act as a stopping means, preventing the lever member from being rotated further when the pads are paralleled with a housing side.

The rotor body is spool-shaped, and formed of two disks at opposing ends, which are separated by two parallel side walls that are spaced apart, defining an axial body opening slot 26 that extends into a split disk at one end. The body is joined axially at the split disk end to the inward side of the lever member. This rotor body opening slot 26 is made the same width as the housing slot 32 and lever member slot 7, in order for the lamp end pins to be able to slide into the body slot at lamp installation.

Figure 7:
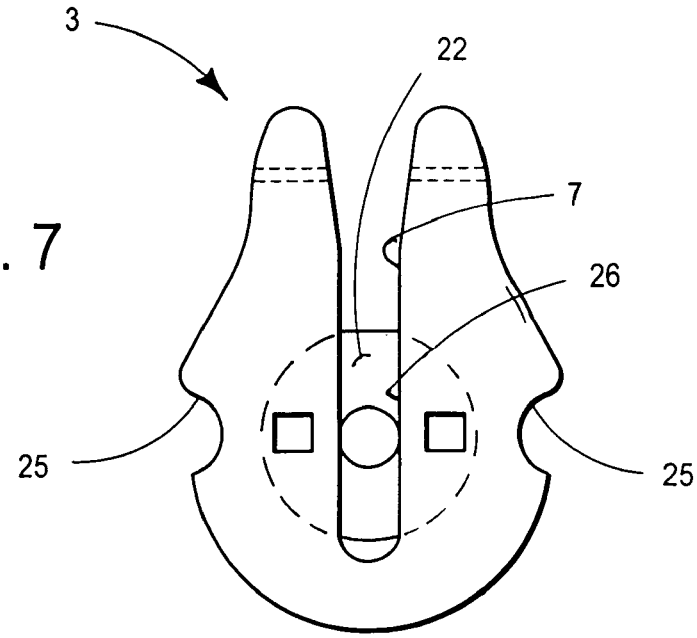
FIG. 7 is a front elevation view of the levered rotor.

In the rotor 3 front elevation view of FIG. 7, a slice of the back end disk 22 of the rotor body is visible through the slot 7 in the lever member, because the rotor body opening 26 width matches the width of the slot 7 and is aligned with it.

A curved cut-out 25 is made in opposite edges of the lever member, to match a center opening 32 in the top of the housing 5 when the lever member is rotated 90 deg. in either direction. Two rivet holes for fastening the rotor are shown.

Figure 8A:
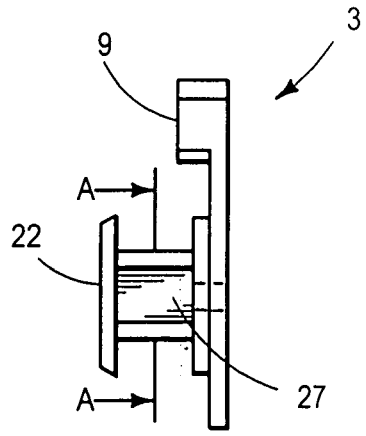
FIG. 8A is a side elevation view of the levered rotor, with its lever arms vertical.
Figure 8B:
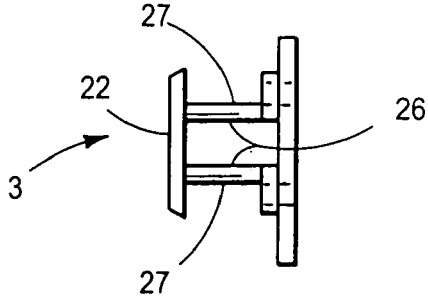
FIG. 8B is a side elevation view of the levered rotor, turned 90 deg., particularly showing a slot opening between two parallel side walls of the rotor body.
Figure 8C:
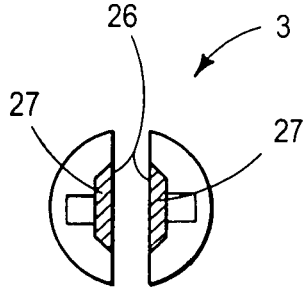
FIG. 8C is a partial back view of the rotor body, taken along plane line A—A of FIG. 8A, particularly showing a slot between two side walls.

FIGS. 8A, 8B and 8C, serve to further illustrate and emphasize the particular structure of the rotor body in the rotor assembly. This feature plus the lever member slot and stops embody the core of the invention.

FIG. 8A is a side elevation view of the rotor 3 in a zero deg. position, with the lever member arms pointing upwards. In this view, the body opening 26 is hidden by a side wall 27.

In FIG. 8B, the rotor 3 has been turned 90 deg. and the body opening 26 is fully visible between the side walls 27; appearing as it would be, to a contact strip inside the housing. If a lamp terminal pins were seated in the rotor lever slot 7 and body opening 26, a contact strip would bear against a pin on both sides.

FIG. 8C is cross-section view of the rotor body taken along line A—A of FIG. 8A. In this view, the body opening 26 is seen to extend into, and split an end desk, which is joined to the lever member and thus appears as shown in FIG. 7.

FIGS. 9 and 10 are respectively, a back elevation view of an uncovered housing 5, and a front elevation view of the housing 5. A large circular first opening 30 is cut in the housing face 4 and sized to permit insertion of the rotor 3 body in assembly of the socket. Starting at the top of the first opening 30, is a second opening 32 which is a slot that continues across the top of the housing. It is this housing opening that is used for insertion of the fluorescent lamp end pins.

The top slot opening 32 continuation is shown in FIG. 12, which is a cross-section view, looking toward the housing top, taken along line B—B of FIG. 9.

A third opening 36 in the housing face is made for riveting the housing to the cover and mounting bracket.

The tops of the clamp posts 21 that are used to retain the rotor body inside the housing, are indicated in FIGS. 9 and 10, and a side view of the posts 21 is given in FIG. 12. The posts 21 are flexible but springy plastic. When the rotor body is pushed through the first opening 30 in the housing face, the posts are initially flexed outwards by the body end disk 22, to let the end disk 22 pass through. The posts 21 then snap back under the end disk 22, clamping the rotor body lightly; preventing withdrawal of the rotor body from the housing 5.

At the bottom, open end of the housing are located three raised blocks; two side blocks 38 and a central block 34. These three blocks define two channels in which the ends of the power leads 15 are placed. FIG. 11, which is a bottom end view of the housing, indicates the channel openings 40 created by the blocked portions. The blocked portions also serve to support the cover lid 19, so that when the cover lid 19 is riveted on the housing, it clamps down on the power leads 15.

Figure 13:
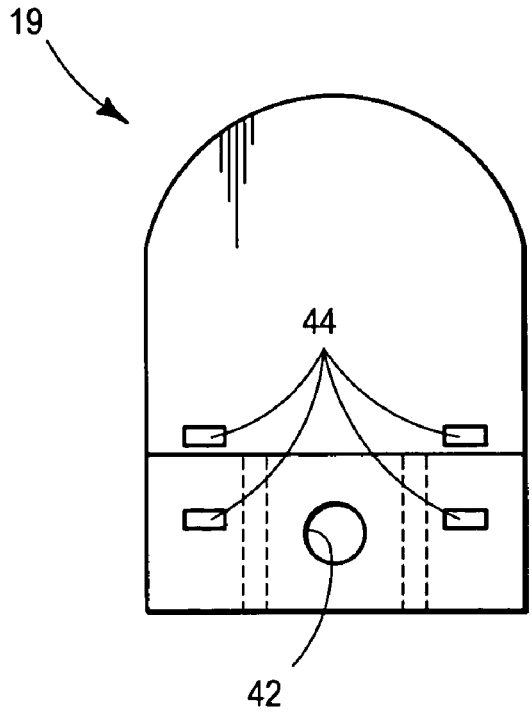
FIG. 13 is an elevation view of the cover lid, showing the location of projections for clamping the electrical power leads inside the housing.
Figure 14:
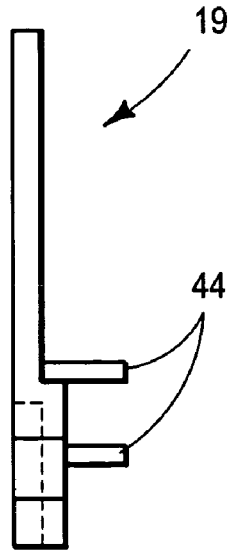
FIG. 14 is a side elevation view of the cover lid.

FIGS. 13 and 14 are respectively, an inside face elevation view and a side elevation view of the cover lid 19. The cover lid includes four horizontally extending, rigid fingers 44 and a fourth opening 42. When the cover lid 19 is riveted in place to the housing, the fingers 44 act as guides for the wire ends of the power leads 15 and also hold them in place, preventing the leads from being pulled out of the socket housing.

As described in the foregoing, the socket is constructed of few parts, and is primarily composed of a molded plastic housing and cover; a molded plastic rotor assembly; a pair of metal electrical contact strips to which power leads are attached, and a mounting bracket for mounting the socket in any direction. The invention socket is thus a simple device that is economical to produce.

The levered socket inherent characteristics ensure that only a complete full electrical contact can be made with inserted lamp terminals, every time the socket lever member is rotated a quarter turn from the lever member lamp installation position. There is therefore, no possibility of only one of two lamp terminal pins making proper electrical contact, such as sometimes occurs with conventional sockets, resulting in possible damage to the lamp.

An advantage over conventional sockets, is that power to an installed fluorescent lamp can be switched off by the socket before removal and replacement of a lamp. This aspect would be much appreciated by anyone who has to remove and replace a hot fluorescent lamp that is installed in a showcase.

Finally, the invention socket design, obviously makes it easy for any unskilled person to install or remove a tubular fluorescent lamp correctly every time, regardless of a lamp size, or the location of the sockets.

From the foregoing description, it is believed that the preferred embodiment achieves the objects of the present invention. Alternative embodiments and modifications will be apparent to those skilled in the art. These and other modifications are considered to be equivalent and within the spirit and scope of the present invention.

Having described the invention, what is claimed is:

1. A fluorescent lamp socket comprising:

(a) a molded plastic housing that is formed in an open shallow box shape and having a back wall, one side of which is a housing face; two parallel, flat side walls that form housing sides; a semi-circular closed end defining a top end and a top wall, and a distal open bottom end; said housing face acting as a front of the socket and including on a vertical axis, a large diameter first hole that is located concentrically with said top end of said housing; and a second hole that is positioned equidistantly between two sides and adjacent to said bottom end, said second hole being sized to seat a rivet; said housing face also including a wide, first slot opening, that is cut from said first hole to said top end and extends across said top wall; extending said first slot opening across the top end of said housing; said housing including means for positioning and retaining two metal contact strips that are separated and disposed vertically inside said housing, and providing two power lead openings in said bottom end;

(b) a pair of long, permanently bent, springy brass contact strips that are each attached to a separate power lead; said contact strips, attached to the wire ends of power leads, being disposed in said housing;

(c) a levered rotor, comprising a molded plastic lever member and a molded plastic rotor body which are fastened together;

said lever member having a flat pear-like shape, composed of a semicircular lower portion and a tapered upper portion, and having a face side and a back side; said lever member including a wide second slot opening that is cut along a vertical axis that extends from a top end of said lever member to a short distance from a bottom edge, and has a slot width that matches the width of said first slot opening in said housing; said second slot opening creating two paralleled lever arms which terminate at the top end; said lever member including two rivet holes in said face side adjacent to said second slot opening, and an arcuate cut-out on each edge, said rivet holes and said cut-outs being disposed along a horizontal axis of the semicircular lower portion;

said rotor body having an elongate spool shape, composed of two opposing end disks that are separated by two axial parallel, flat surfaced struts that are body side walls, which define a third slot opening through said rotor body, said third slot opening extending through one end disk, creating a split disk; said third slot opening having a slot width that matches the width of said first slot opening in said housing; said rotor body being fastened perpendicular to said back side of said lever member, having said split disk fastened to the back side, with the split disk centered on the horizontal axis of said semicircular lower portion, and said third slot opening aligned with said second slot opening in said lever member;

said levered rotor having said rotor body placed inside said first hole in said housing face and able to be rotated by manual use of said lever arms; said lever arms being normally set in a vertical position, with said second slot opening vertical and lined up with said first slot opening in said housing; said vertical position permitting the entrance of the end pins of a fluorescent lamp into said first opening in the top end of said housing;

(d) first means for stopping said levered rotor from being rotated more than plus or minus 90 degrees from said vertical position of said lever arms;

(e) second means for retaining said rotor body of said levered rotor inside said housing;

(f) a molded, rigid plastic cover lid that is shaped to fit into and close said housing; said cover lid including a second rivet hole for use in fastening a mounting bracket and connecting said cover lid to said housing;

(h) a metal mounting bracket; and (i) a rivet, sized for fastening said mounting bracket and said cover lid to said housing;

said socket, after insertion of a lamp end pins, acting as a switch and closing connections to electric power when said lever arms are rotated either +90 deg. or −90 deg. with reference to the normal, vertical lever arms position.

2. The lamp socket according to claim 1, wherein;

said first means includes a stepped, rigid portion forming a pad that is disposed on said back side of both said lever arms at lever arm top ends; said lever member, when rotated plus or minus 90 degrees from the normal vertical position, causing said pad to come up hard against a housing side, stopping any further rotor movement in the direction of rotation.

3. The lamp socket according to claim 1 wherein;

said second means includes two flexible plastic posts; a post being fastened perpendicularly to the back wall of said housing, adjacent to each side edge of said first hole; said posts being shaped at a top end, so that a rotor body end disk that is inserted in said first hole between the posts, will bend the posts outwards, allowing the rotor body end disk to move beyond the top end of the posts; the posts then snap inwards and clamp the rotor body immediately under the end disk, retaining the rotor body of the levered rotor in the housing.

* * * * *